US005105173A

United States Patent [19]

Itou

[11] Patent Number: 5,105,173

[45] Date of Patent: Apr. 14, 1992

[54] BAND-PASS FILTER USING MICROSTRIP LINES

[75] Inventor: Atsushi Itou, Osaka, Japan

[73] Assignee: Sanyo Electric Co., Ltd., Moriguchi, Japan

[21] Appl. No.: 615,554

[22] Filed: Nov. 19, 1990

[30] Foreign Application Priority Data

Nov. 20, 1989 [JP] Japan ..... 1-301104
Nov. 20, 1989 [JP] Japan ..... 1-301105

[51] Int. Cl.[5] ..... H01P 1/203

[52] U.S. Cl. ..... 333/204; 333/203; 333/205

[58] Field of Search ..... 333/202-205, 333/206, 219, 235, 246; 29/600

[56] References Cited

U.S. PATENT DOCUMENTS 4,266,206 5/1981 Bedard et al. ..... 333/204
4,288,530 9/1981 Bedard et al. ..... 333/205 X
4,371,853 2/1983 Makimoto et al. ..... 333/204
4,506,241 3/1985 Makimoto et al. ..... 333/206 X
4,733,208 3/1988 Ishikawa et al. ..... 333/202
4,975,664 12/1990 Ito et al. ..... 333/204 X

FOREIGN PATENT DOCUMENTS 0091001 4/1987 Japan ..... 333/204
0219203 9/1988 Japan ..... 333/204

*Primary Examiner*—Eugene R. LaRoche
*Assistant Examiner*—S. Ham
*Attorney, Agent, or Firm*—Armstrong, Nikaido, Marmelstein, Kubovcik & Murray

[57] ABSTRACT

A microwave band-pass filter of interdigital type employing microstrip lines and a filter characteristic adjusting method thereof are disclosed. The microwave band-pass filter includes plural stages of resonant lines. Furthermore, the resonant line includes a short-circuit portion, an open portion and a connection portion. The short-circuit portion has its one end grounded and the open portion has its one end open. The connection portion is interposed between the short-circuit portion and the open portion and has its width gradually increased from both sides of the short-circuit portion to both sides of the open portion.

15 Claims, 12 Drawing Sheets

BAND-PASS FILTER USING MICROSTRIP LINES

BACKGROUND OF THE INVENTION

1. Field of the Invention

The present invention relates to microwave band-pass filters using microstrip lines and an adjusting method of the filter characteristic, and more particularly to microwave band-pass filters of which miniaturization and improvement of the filter characteristic are possible and a filter characteristic adjusting method thereof.

2. Description of the Background Art

Microwave band-pass filters utilizing the resonance of distributed parameter circuits are frequently used at present in the fields such as the satellite broadcasting, the personal radio. The microwave band-pass filters include two types, the comb line type and the interdigital type.

As shown in FIG. 17, a microwave band-pass filter of comb line type includes a dielectric substrate A, a grounding electrode B formed all over the back surface of the dielectric substrate A, a short-circuit electrode 4 formed on one side in a width direction of the dielectric substrate A, a plurality of resonant lines 11, 12, 13 formed in a length direction of the dielectric substrate A, of which one ends are commonly connected to the short-circuit electrode 4, an input line 2 connected to the resonant line 11 at the first stage among the plural stages of resonant lines, and an output line 3 connected to the resonant line 13 at the last stage among the plural stages of resonant lines. The dielectric substrate A formed of dielectric material having permittivity of about 90, e.g. $BaO\text{-}Nd_2O_3\text{-}TiO_2$ system material has a width of H. Each resonant line 11, 12, 13 has a length of L and a width of W.

In the above-described structure, the energy of the microwave inputted to the resonant line 11 is imprisoned in the dielectric substrate A to produce a standing wave having $\frac{1}{4}$ wave length. Accordingly, when the wave length of the supplied microwave is $\lambda_0$ and the effective permittivity of dielectric substrate A is $\epsilon$, the length of a resonant line can be $\lambda_0/4\sqrt{\epsilon}$. The characteristic impedance Zo of the resonant line is proportional to H/W.

FIG. 18 is a diagram showing a microwave band-pass filter of interdigital type. The microwave band-pass filter includes short-circuit electrodes 41, 42 formed on both sides in a width direction of a dielectric substrate A, resonant lines 11, 13 connected to the short-circuit electrode 41, a resonant line 12 connected to the short-circuit electrode 42, and an input line 2 and an output line 3 connected to the short-circuit electrode 42.

Referring to FIGS. 17 and 18, the comb line type and the interdigital type are different in that one ends of resonant lines of the comb line type are commonly connected to a short-circuit line, but one ends of resonant lines of the interdigital type are alternately connected to short-circuit electrodes 41, 42.

FIG. 19 is a diagram for describing the relationship between a coupling coefficient $k_1$ between resonant lines of a microwave band-pass filter of comb line type and a coupling coefficient $k_2$ between resonant lines of a microwave band-pass filter of interdigital type. Here, the coupling coefficient means the strength of inductive coupling between resonant lines. The coupling coefficient k is proportional to an interval d between resonant lines. The coupling coefficient $k_1$ of a comb line type microwave band-pass filter is larger than the coupling coefficient $k_2$ of an interdigital type microwave band-pass filter because the directions of electric fields in adjacent intervals between resonant lines of interdigital type are reverse to each other in contrast to that the directions of electric fields in adjacent intervals between resonant lines of comb line type are the same. Accordingly, when the same coupling coefficient k' is taken, an interval between resonant lines of interdigital type is a, and an interval between resonant lines of comb line type is b. From this fact, it can be said that a microwave band-pass filter of interdigital type is more advantageous than a microwave band-pass filter of comb line type in miniaturization.

So-called stepped impedance type resonant lines in which the width of an open end side of each resonant line is larger than the width on the short-circuit side are disclosed (Japanese · Patent Laying-Open No. 62-164301).

FIG. 20 is a diagram showing a microwave band-pass filter employing resonant lines of stepped impedance type disclosed in the above-identified gazette. Referring to the figure, each resonant line 11, 12, 13 includes a short-circuit portion 1*c* commonly connected to a short-circuit electrode 4 at its one end, an open portion 1*a* of which one end is open and width is wider than the width of the short-circuit portion 1*c*, and a connection portion 1*b* interposed between the open portion la and the short-circuit portion 1*c*. Also, the microwave band-pass filter includes a guard electrode 5 extending from the short-circuit electrode 4 to the main surface. The guard electrode 5 is formed in order to prevent difference of dimensions of resonant lines and so forth because of up and down movement of a circuit pattern in a length direction when forming a certain pattern on a substrate by the screen printing method, for example.

In the above-described structure, because the open portion 1*a* is wider than the short-circuit portion 1*c*, the electrostatic capacity can be made large. Thus, resonant frequency decreases. As a result, as compared to a microwave band-pass filter of resonant frequency same as the decreased resonant frequency, the length of resonant lines can be shorter to reduce size of a dielectric substrate.

However, the shape of the connection portion 1*b* is step-formed, so that disorder of an electric field and a magnetic field in the discontinuous portion become great, which causes a problem of degradation of a quality factor Q.

Also, for example, when forming a circuit pattern by the screen printing method, since the connection portion 1*b* is step-formed, an edge of a mask is changed in its form depending on the frequency in use of the mask. As a result, edge portions of connecting portions 1*b* have variations in shape to cause variations in the resonant frequency.

Furthermore, since capacitance is parasitically produced between the guard electrode 5 and open ends of the resonant lines 11, 12, 13, there is a problem that the capacitance influences the filter characteristic.

Furthermore, there are small differences in permittivity of dielectric substrates A, which produce differences in substantial length of the resonant lines and electrostatic capacitance to influence the filter characteristic.

SUMMARY OF THE INVENTION

Accordingly, it is an object of the present invention to make Q flat in a band-pass filter in which the width of an open side of a resonant line is wider than that of a short-circuit side.

It is another object of the present invention to restrain a disorder of an electric/magnetic field between resonant lines.

It is still another object of the present invention to restrain variations in dimensions of circuit patterns when screen printing circuit patterns on dielectric substrates.

It is yet another object of the present invention to restrain variations in filter characteristics produced due to variations of permittivity of dielectric substrates and variations in dimensions of circuit patterns.

Briefly stated, a microwave band-pass filter according to the present invention includes a dielectric substrate, a grounding electrode, short-circuit electrodes, resonant lines, an input line, and an output line. A grounding electrode is formed all over one main surface of the dielectric substrate. The short-circuit electrode is connected to the grounding electrode and formed on both sides in a width direction of the dielectric substrate. The resonant lines are formed in length directions on the other main surface of the dielectric substrate. Furthermore, the resonant lines include short-circuit portions, open portions and connection portions. The short-circuit portions are alternately connected to short-circuit electrodes formed on both sides in a width direction of the dielectric substrate at one ends thereof. One end of the open portion is opened and has a width wider than that of the short-circuit portion. The connection portion is interposed between the open portion and the short-circuit portion and has a width gradually increased in the direction toward the connection portion from the short-circuit portion. The input line is electromagnetically coupled to a resonant line at the first stage among a plurality of resonant lines. The output line is electromagnetically coupled to the resonant line at the final stage among a plurality of resonant lines.

In operation, connection portions of a plurality of resonant lines have gradually increased width, so that the disorder of an electric field and a magnetic filed between adjacent resonant lines and between resonant lines and input/output lines can be restrained. As a result, reflected waves can be restrained to make Q flat. Also, by gradually increasing the width of the connection portion, an edge angle of the connection portion can be made larger than a conventional case, so that the change in shape of the edge portion in screen printing can be avoided. As a result, variations of circuit patterns can be eliminated.

Briefly stated, in another aspect of the present invention, the filter characteristic adjusting method according to the present invention is a method in which a portion of a short-circuit electrode or a guard electrode is removed in a microwave band-pass filter including a short-circuit electrode and a guard electrode.

In operation, by removing a part of a short-circuit electrode or a guard electrode, the capacitance parasitically produced between open ends of resonant lines and the guard electrode can be decreased. As a result, the variations in filter characteristics due to variations in permittivity of dielectric substrates and variations in dimensions of resonant lines can be prevented.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
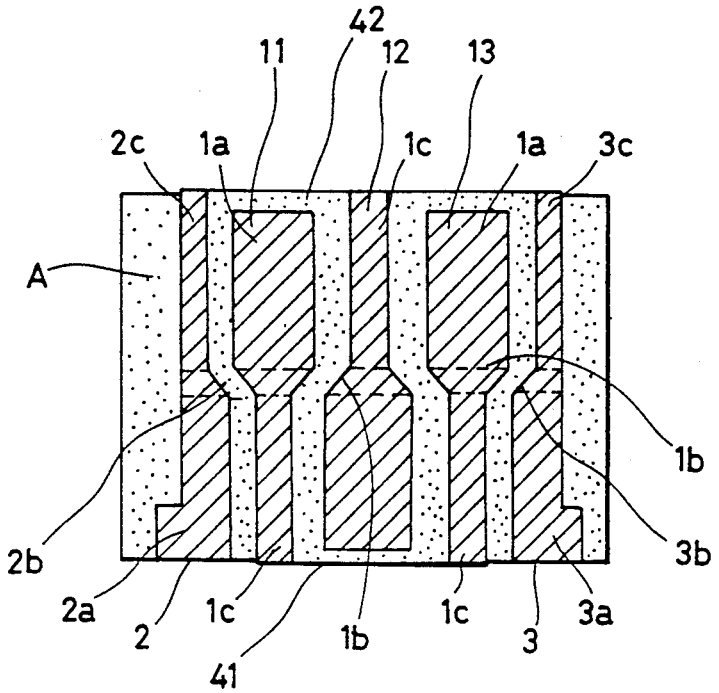
FIG. 1 is a diagram showing one embodiment of a microwave band-pass filter according to the present invention.
Figure 18:
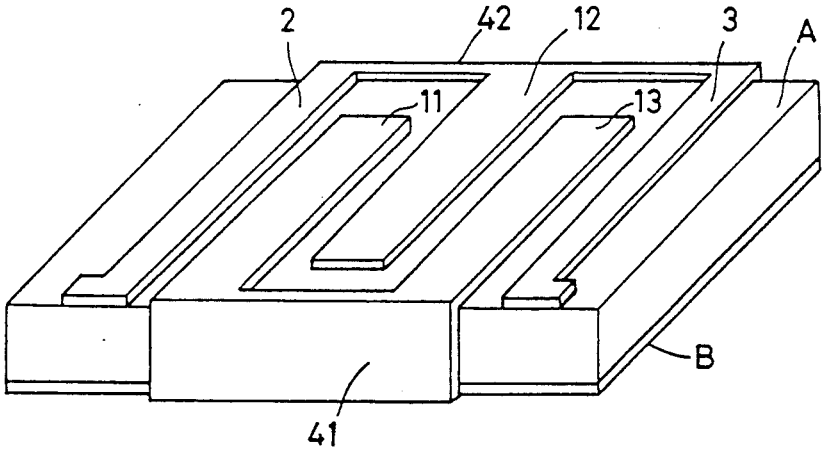
FIG.18 PRIOR ART
FIG. 18 is a diagram showing a conventional interdigital type microwave band-pass filter.
Figure 19:
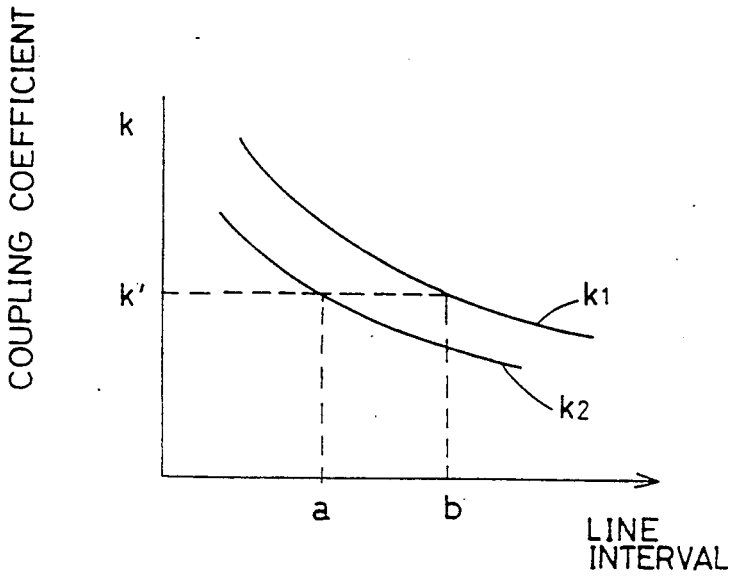
FIG.19 PRIOR ART
FIG. 19 is a diagram for describing the relationship between a coupling coefficient and the distance between resonant lines.
Figure 20:
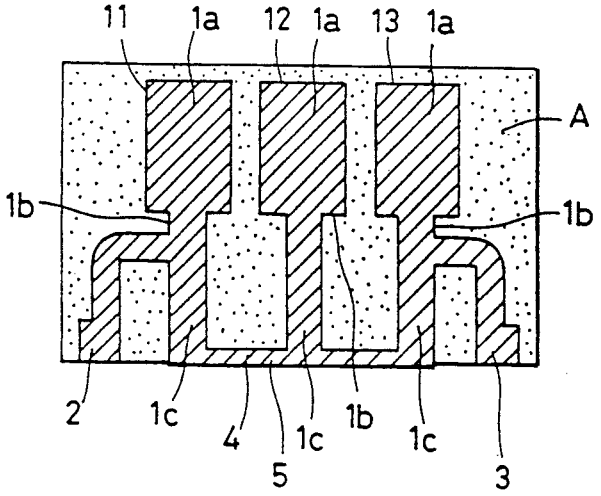
FIG.20 PRIOR ART
FIG. 20 is a diagram showing a conventional microwave band-pass filter using resonant lines of stepped impedance type.

FIG. 1 is a diagram showing one embodiment of a microwave band-pass filter of the present invention. Referring to the figure, this microwave band-pass filter and the microwave band-pass filters shown in FIGS. 18 and 20 are different in that the width of connecting portions 1*b* of resonant lines 11, 12, 13 is gradually increased according to a constant ratio from a short-circuit portion 1*c* to an open portion 1*a*, and that the width of connection portions 2*b*, 3*b* of an input line 2 and an output line 3 is incline to be parallel with the sides of adjacent resonant lines. By forming such a circuit pattern, the angle of the edge of the connection portion 1*b* can be made wider, so that concentration of electric charge to the edge portion can be restrained. As a result, the disorder of an electric field and a magnetic filed between connection portions 1b of adjacent resonant lines can be restrained. Also, the disorder of the magnetic/electric field between the connection portion 1b of resonant line 11 and the connection portion 2b of input line 2 and the magnetic/electric field between the connection portion 1b of resonant line 13 and the connecting portion 3b of output line 3 can be restrained. Accordingly, reflected waves due to the disorder of the electric and magnetic field can be restrained to make Q flat.

Furthermore, since the edge angle of connecting portions 1b, 2b and 3b is wider than the edge angle of conventional stepped impedance type, damage of a mask in screen printing can be prevented. As a result, variations in dimensions of resonant lines 11, 12, 13 and input/output lines 2, 3 can be restrained. Accordingly, the distances between resonant lines can be kept constant to prevent variations in coupling coefficients.

Furthermore, by increasing the width of open portion 1a, electrostatic capacitance can be increased, so that the area of substrate A can be reduced by 10 through 20% as compared to the microwave band-pass filter shown in FIG. 18.

Figure 2:
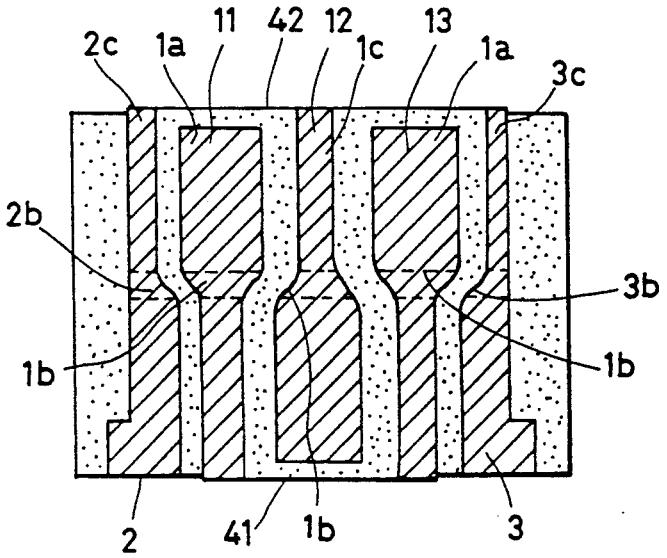
FIG. 2 is a diagram showing another embodiment.

FIG. 2 is a diagram showing a modification of the microwave band-pass filter of FIG. 1. Referring to the figure, this microwave band-pass filter is different from the microwave band-pass filter of FIG. 1 in that positions of connection portions 1b of resonant lines 11, 12, 13 and edges of connection portions 2b, 3b of input/output lines 2, 3 are formed according to predetermined curvature radiuses. This microwave band-pass filter also operates similarly to the microwave band-pass filter of FIG. 1 and has the same effect.

Figure 3:
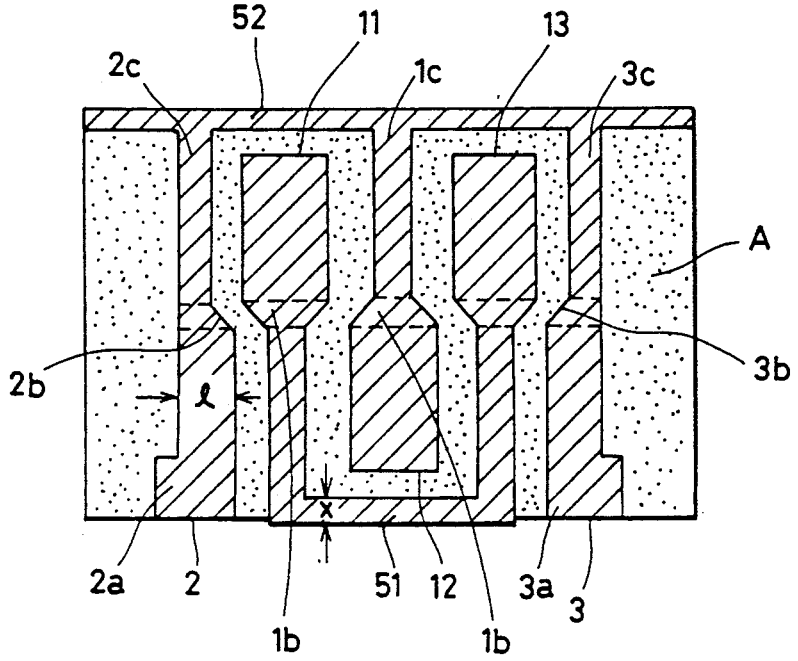
FIG. 3 is a diagram in which a guard electrode is provided in the embodiment of FIG. 1.

FIG. 3 is a diagram showing a microwave band-pass filter of FIG. 1 provided with guard electrodes. Referring to the figure, guard electrodes 51 and 52 enhance the dimensional accuracy when forming a circuit pattern on dielectric substrate A according to the screen printing method as described above. By providing guard electrodes 51, 52, however, the length of electromagnetically coupling portion (hereinafter referred to as a coupling length) of input line 2 and resonant line 11 and the coupling length of output line 3 and resonant line 13 are longer by the length x of the guard electrode than the coupling length of resonant line 11 and resonant line 12 and the coupling length of resonant line 12 and resonant line 13. The difference in the coupling lengths increases ripples in the band. Therefore, as shown in FIGS. 4 and 5, the shapes of open ends of resonant lines 11, 13 adjacent to input/output lines 2, 3 are devised.

Figure 4A:
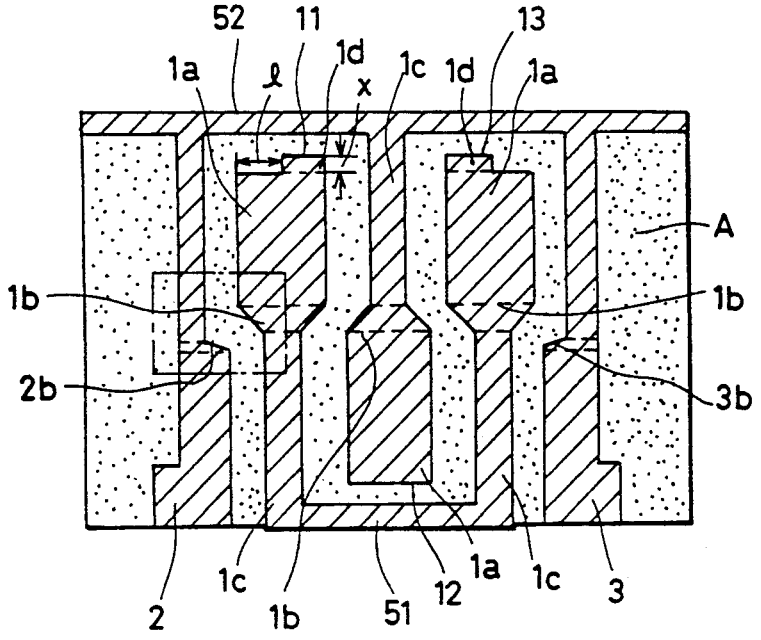
FIG. 4A is a diagram in which a connection portion of an open portion of a resonant line and input/output lines is improved.
Figure 4B:
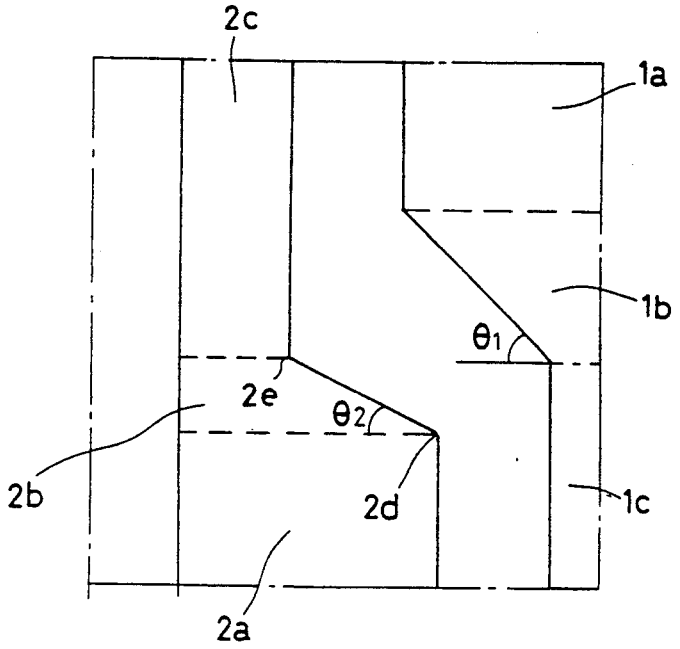
FIG. 4B is an enlarged diagram of the portion surrounded by a chain line of FIG. 4A.

FIG. 4A is a diagram showing an example in which the microwave band-pass filter of FIG. 3 is improved. FIG. 4B is an enlarged view of a portion surrounded by a chain line of FIG. 4A. Referring to the figures, open portions 1a of resonant lines 11, 13 are made shorter by the length x of the guard electrode. A rectangular portion 1d having a length x on one side and a length obtained by subtracting the width l of the input/output lines from the width of the open end on the other side is formed on the resonant line 12 side of open end 1a. In other words, resonant lines 11, 13 have shapes in which rectangular portions are removed on the input/output line 2, 3 sides. In this way, the coupling lengths among respective lines can be made equal. As a result, ripples in the band can be reduced.

Also, the angle between the horizontal direction and the side connecting connection point 2e to short-circuit portion 2c of connection portion 2b and connection point 2d to input portion 2a of input line 2 is different from the tilt angle with respect to a horizontal direction of a side of resonant line 11. In this way, by adjusting the tilt angle of a side of a connection portion 2b and a position of connection portion 2b, fine adjustment can be applied to coupling coefficients. Fine adjustment of coupling coefficients, for example, can be applied easier by adjusting tilt angles rather than narrowing down the width of distances in the case where the intervals among input/output lines 2, 3 and resonant lines 11, 13 have to be narrowed down to about 200 μm to increase coupling coefficients.

Figure 5:
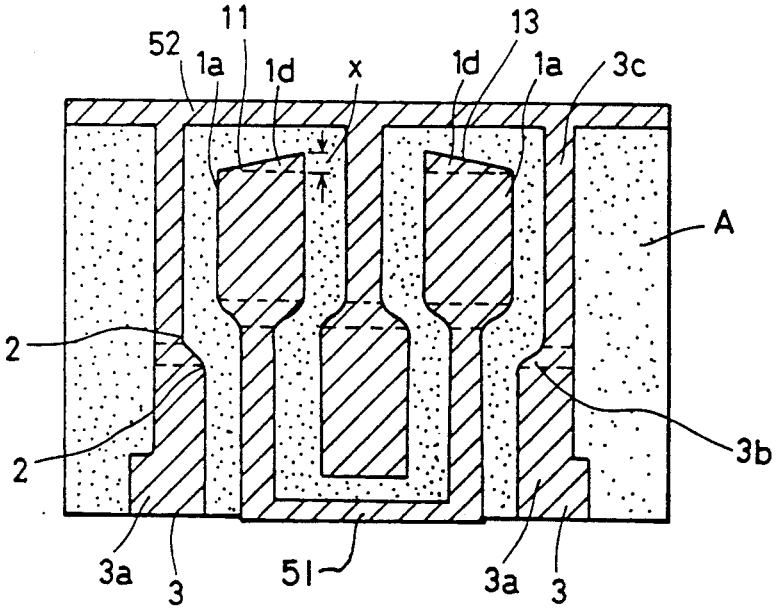
FIG. 5 is a diagram showing a modified example of FIG. 4.

FIG. 5 is a diagram showing a modification of the microwave band-pass filter of FIG. 4.

By shortening the length of open portions 1a of resonant lines 11, 13 by the length x of a guard electrode, a right angled triangle portion 1d is formed having one side with a length corresponding to the width of open portion 1a and a height x is formed. Edge portions of resonant lines 11, 12 and 13 and input/output lines 2, 3 have predetermined curvature radiuses.

This microwave band-pass filter also has the same filter characteristic as that of the microwave band-pass filter of FIG. 4.

Figure 6:
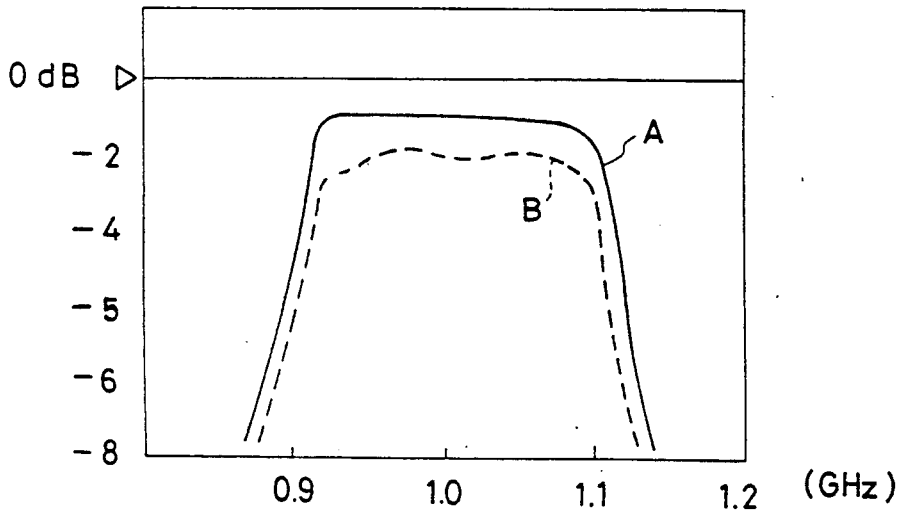
FIG. 6 is a diagram showing filter characteristics of the microwave band-pass filter of FIGS. 3 and 4.

FIG. 6 is a diagram showing the filter characteristics of FIGS. 4 and 5, and the filter characteristics of the microwave band-pass filter shown in FIG. 3. The curve A shows a gain of the microwave band-pass filter shown in FIG. 4. The curve B shows a gain of the microwave band-pass filter shown in FIG. 3.

Figure 7A:
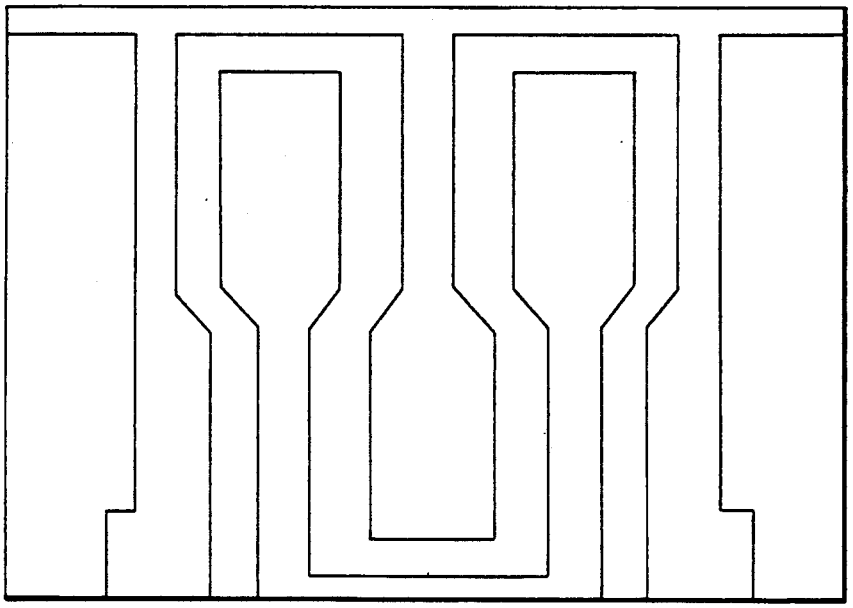
FIGS. 7A and 7B are diagrams showing actual dimensions of the microwave band-pass filters of FIGS. 3 and 4, respectively.
Figure 7B:
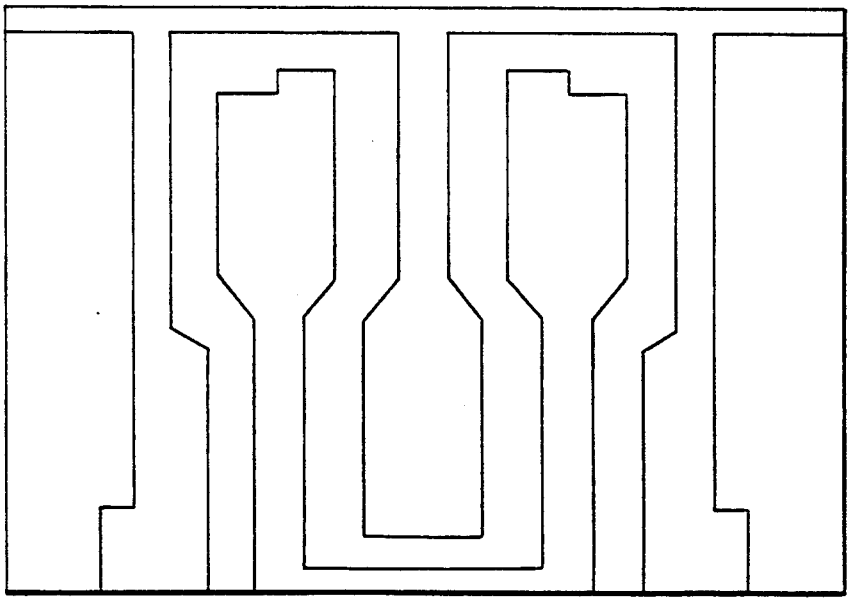

The actual dimensions employed in measuring the filter characteristics are shown in FIGS. 7A and 7B. The employed dielectric substrate has a thickness of 1.5 mm, a width of 10.0 mm, and a length of 6.6 mm. The unit in the figure is mm. From the measured results shown in FIG. 6, it is understood that a gain A in a bandwidth of microwave band-pass filters shown in FIGS. 4 and 5 is more flat than a gain B of the microwave band-pass filter shown in FIG. 3.

In the embodiments described above, a circuit pattern is formed by the screen printing method. Next, a method for forming a circuit pattern by photolithography instead of this method will be described. The photolithography method has disadvantage in the aspect of cost, but the dimensional accuracy of a pattern is enhanced when it is employed.

Figure 8B:
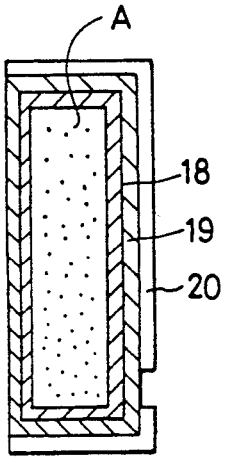
FIGS. 8A–8E and 9 are diagrams for describing the steps for forming a microwave band-pass filter.
Figure 8A:
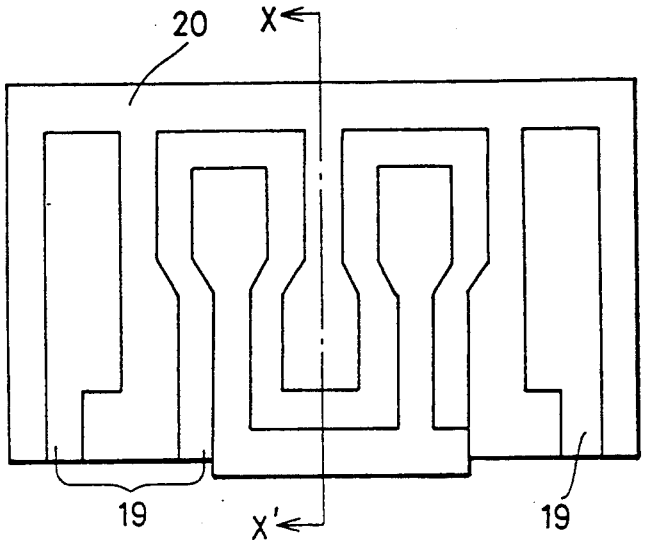
Figure 8C:
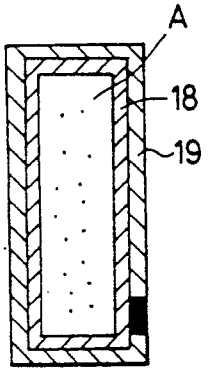
Figure 8D:
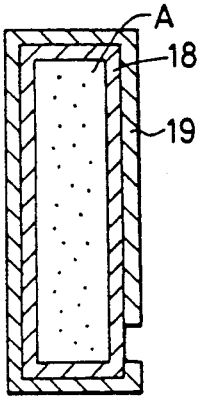
Figure 8E:
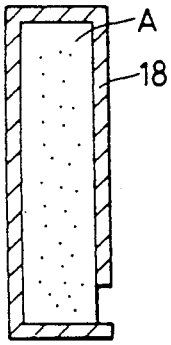
Figure 9:
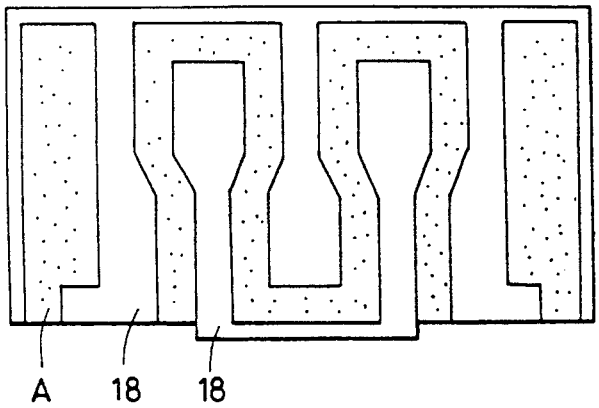

A metal layer 18 such as silver and copper is formed all over the surface of a dielectric substrate A by an electroless plating method and so forth. Next, a photoresist layer 19 is formed and a mask 20 in which a predetermined circuit pattern is formed is provided on the photoresist layer 19 (refer to FIGS. 8A and 8B). Next, the photoresist layer 19 is exposed to light. Next, after removing mask 20, the exposed photoresist layer 19 is removed (FIG. 8C). The unnecessary portions of metal layer 18 is removed by etching (FIGS. 8D and 8E) to form a predetermined circuit pattern (FIG. 9).

Figure 10:
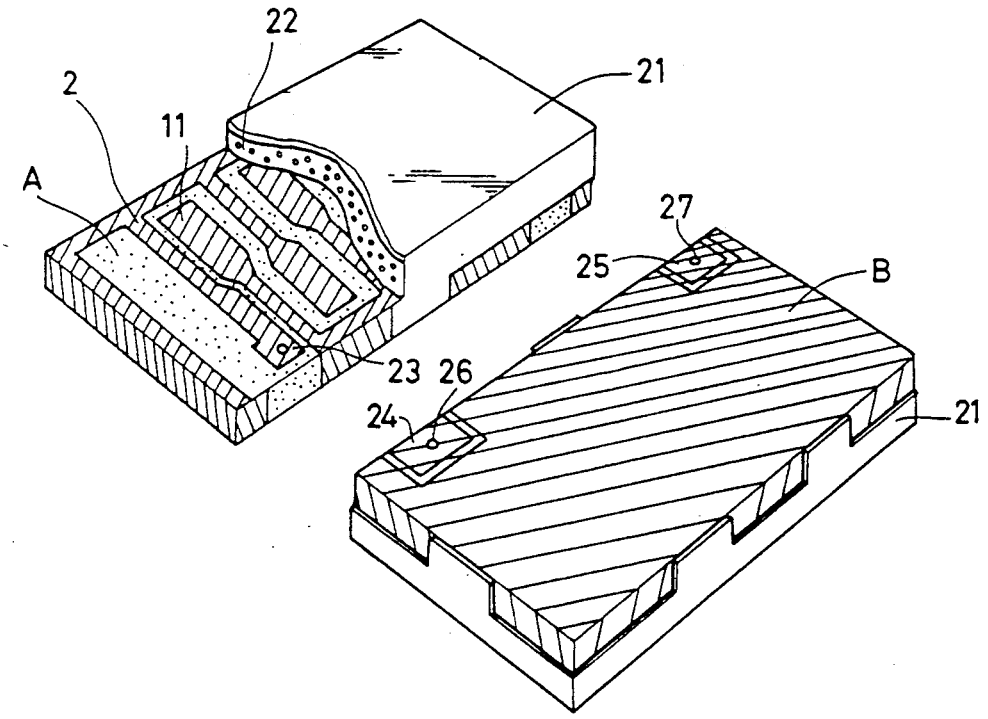
FIG. 10 is a packaging diagram of a microwave band-pass filter.

FIG. 10 is a package diagram of a microwave band-pass filter. This microwave band-pass filter includes a dielectric substrate A on which a circuit pattern is formed, a metal case 21, and a resin member 22 interposed between the metal case 21 and the dielectric substrate A. On the back of dielectric substrate A, an input electrode 24 and an output electrode 25 are formed at positions opposing to an input terminal 23 of an input line 2 and an output terminal of an output line. A through hole 26 passing through input electrode 24 and input terminal 23 is formed and also a through hole 27 passing through output electrode 25 and the output terminal is formed.

Next, the method of adjusting the filter characteristics of a microwave band-pass filter will be described. This filter characteristic adjusting method of microwave band-pass filters can be used both in case of comb line type and interdigital type.

Figure 11:
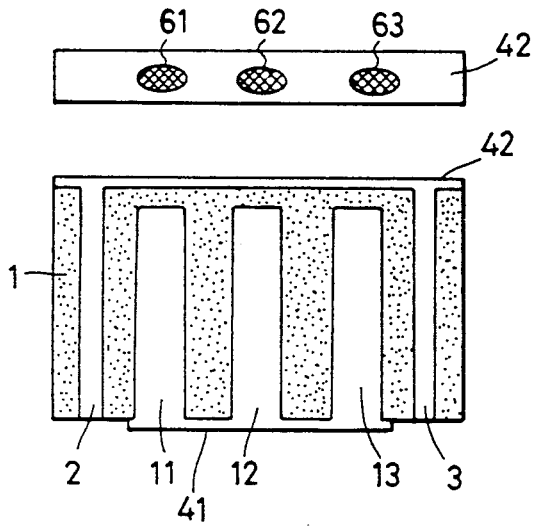
FIG. 11 is a diagram for describing trimming positions of a microwave band-pass filter in adjusting the center frequency.

FIG. 11 is a diagram showing trimming 1 in adjusting a center frequency of a microwave band-pass filter of comb line type. Referring to the figure, this microwave band-pass filter is characterized in that a short-circuit electrode 42 is provided also on open end sides of resonant lines 11, 12, 13, and that positions 61, 62, 63 opposing to open ends of resonant lines 11, 12, 13 of a short-circuit electrode 42 are subjected to trimming.

In such a filter, it is known that the resonant frequency $f_0$ is given by the following expression, $$f_0 = 75/L\cdot\sqrt{\epsilon}$$

Here, L is a length of the resonant lines 11, 12, 13 and $\epsilon$ is an effective permittivity of dielectric substrate A.

Figure 12:
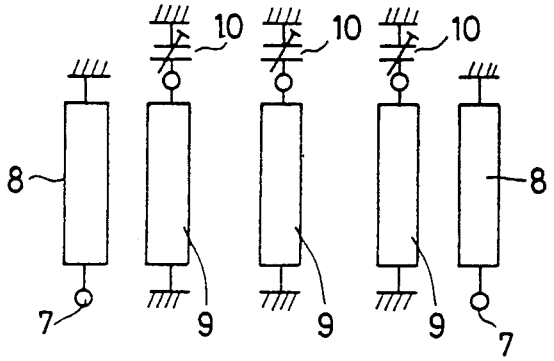
FIG. 12 is a diagram showing an equivalent circuit of a microwave band-pass filter subjected to trimming.

FIG. 12 is a diagram showing an equivalent circuit of a microwave band-pass filter which is subjected to trimming. Referring to the figure, each resonant line 11, 12, 13 includes a capacitance component and an inductance component and expressed as a unit element 9. An input line 2 and an output line 3 include a capacitance component and an inductance component and expressed as a unit element 8. 7 denotes an input terminal and an output terminal. By applying trimming to a part of a short-circuit electrode 42, parasitic capacitance 10 between unit element 9 and a grounding terminal is reduced. As a result, the center frequency $f_0$ can be changed as shown in FIG. 13.

Figure 13:
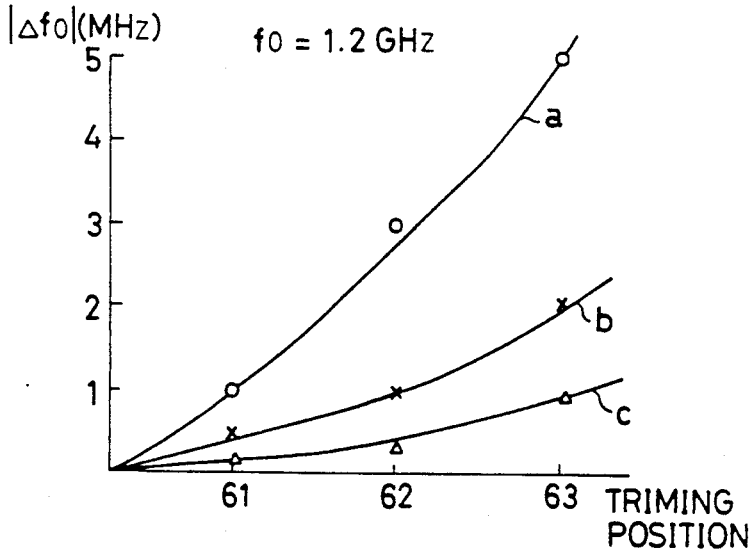
FIG. 13 is a graph for describing the effect by trimming.

FIG. 13 is a graph showing the effect by trimming. Here, the actual dimensions of the microwave band-pass filter employed in the measuring are illustrated in the following:

dimensions of substrate A; thickness 0.85 mm, width 18.0 mm, length 10.4 mm dimensions of a resonant line; length 9.9 mm, width 3.7 mm dimensions of input/output lines; length 10.4 mm, width 2.7 mm intervals between resonant lines; 0.55 mm, intervals between input/output lines and resonant lines; 0.48 mm Referring to FIG. 13, the axis of ordinates shows a changing rate $\Delta f_0$ (Mhz) of a center frequency $f_0$ and the axis of abscissa shows trimming positions. (a) shows the changed amount of the center frequency in the case of a trimming amount of 6 $mm^2$, (b) trimming of 4 $mm^2$, and (c) trimming of 2 $mm^2$. From the characteristic figure, it is known that the changed amount of the center frequency varies depending on trimming positions and trimming amounts. Also, basically, the trimming positions and the amounts in this case are bilaterally symmetrical with respect to a length direction of resonant lines.

Figure 14:
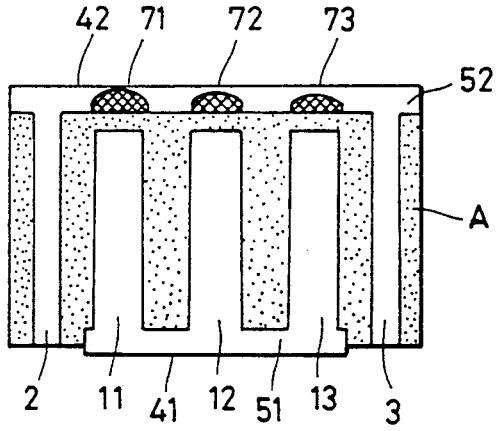
FIG. 14 is a diagram showing trimming positions when restraining ripples.

FIG. 14 is a diagram showing trimming positions in the case of restraining ripples. Referring to the figure, adjustment of ripples in the band is performed by trimming a part of guard electrode 52 opposing to open ends of resonant lines 11, 12, 13.

Figure 15:
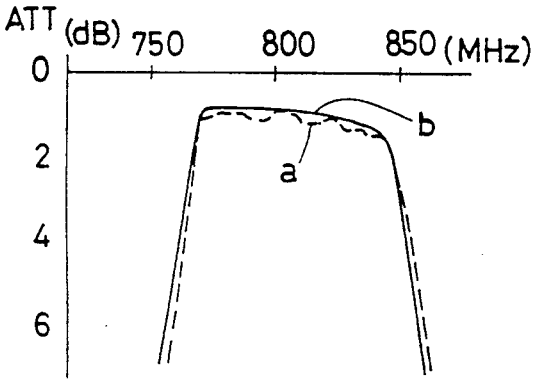
FIG. 15 is a diagram for describing ripple restraint.

FIG. 15 is a diagram for describing restraining effect of ripples. Referring to the figure, (a) is a characteristic curve before trimming the microwave band-pass filter of FIG. 14, and (b) is a characteristic curve after trimming. As seen from the figure, the characteristic curve after trimming has no ripples and has flat characteristic.

Figure 16:
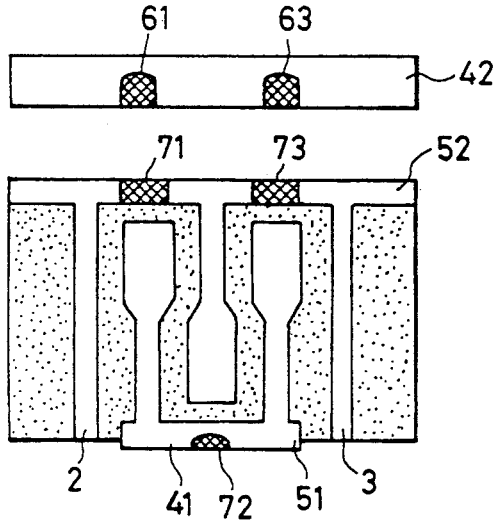
FIG. 16 is a diagram for describing adjustment of the filter characteristics of the microwave band-pass filter shown in FIG. 3.
Figure 17:
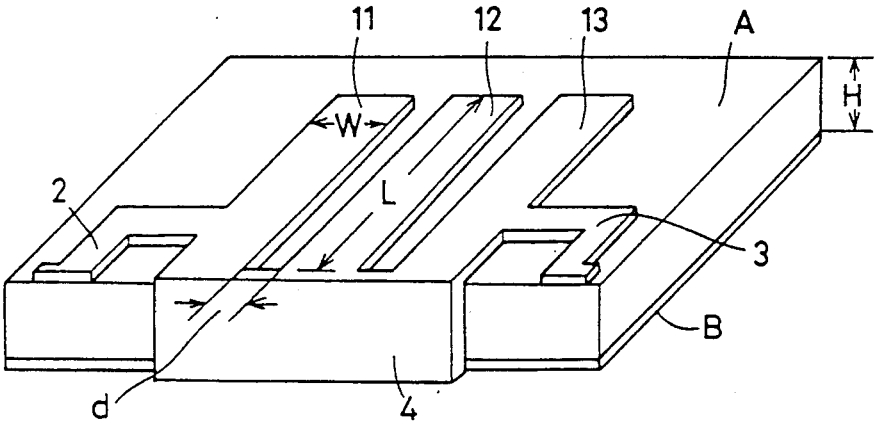
FIG.17 PRIOR ART
FIG. 17 is a diagram showing a conventional comb line type microwave band-pass filter.

FIG. 16 is a diagram for describing adjustment of the filter characteristic of the interdigital type microwave band-pass filter of FIG. 3 according to the present invention. Referring to the figure, by trimming a part of a short-circuit electrode and a guard electrode of the interdigital type microwave band-pass filter, the center frequency can be varied to make the filter characteristic flat.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A microwave band-pass filter, comprising:

a dielectric substrate;

a first electrode formed in an entire region on one major surface of said dielectric substrate;

a second electrode connected to said first electrode and formed on both sides in a width direction of said dielectric substrate;

a plurality of resonant lines formed in a length direction on the other main surface of said dielectric substrate;

each resonant line comprising a first portion of which one end is alternately connected to the second electrode formed on one side or the other side in a width direction of the dielectric substrate, a second portion of which one end is opened and has a larger width than that of said first portion, a third portion connected to said first portion and second portion having a width gradually increasing from said first portion to said second portion;

said band-pass filter further comprising an input line electromagnetically coupled only to a resonant line at a first stage among said plurality of resonant lines and connected to the second electrode of said first stage resonant line at an end opposing said opened end; and an output line electromagnetically coupled to a resonant line at a final stage among said plurality of resonant lines, and connected to the second electrode of said final stage resonant line at an end opposing said opened end;

wherein said each input line and output line comprises a first portion having its one end connected to the second electrode, a second portion having one open end and a width wider than the width of the first portion, and a third portion having its width gradually increasing from said first portion to second portion, and sides of said third portion are inclined toward said first stage and said final stage resonant lines; and wherein a direction of inclination of said sides of said third portions of said input and output line with respect to the resonant lines of said first stage and said final stage are determined such that coupling coefficients between the input line and the resonant line at the first stage, and between the output line and the resonant line at the final stage are set to appropriate values.

2. The microwave band-pass filter according to claim 1, wherein said dielectric substrate has permittivity of 90 or more.

3. The microwave band-pass filter according to claim 1, wherein said dielectric substrate comprises dielectrics selected from materials of $BaO-Nd_2O_3-TiO_2$ system.

4. The microwave band-pass filter according to claim 1, wherein materials of said each electrode, said each resonant line and each of input/output lines are selected from materials having high conductivity.

5. The microwave band-pass filter according to claim 4, wherein said materials having high conductivity include silver.

6. The microwave band-pass filter according to claim 1, wherein said microwave band-pass filter is formed by a screen printing method.

7. The microwave band-pass filter according to claim 1, wherein said microwave band-pass filter is formed by applying photolithography to a dielectric substrate provided with a metal layer formed all over the surface thereof.

8. The microwave band-pass filter according to claim 7, wherein said metal layer is formed by electroless plating.

9. The microwave band-pass filter according to claim 1, wherein said third portion of said resonant line has its width increasing according to a constant increase function and wherein sides of the third portion have an arcuate 10. The microwave band-pass filter according to claim 1, wherein a tilt angle of sides of said input/output lines is equal to a tilt angle of the third portion of said resonant line with respect to a reference line.

11. The microwave band-pass filter according to claim 1, wherein a tilt angle of said input/output lines is different from a tilt angle of the resonant lines.

12. The microwave band-pass filter according to claim 1, wherein said second electrode comprises a guard electrode formed extending from a side surface to the other main surface of said dielectric substrate.

13. The microwave band-pass filter according to claim 12, wherein said first stage and final stage resonant lines comprise fourth portions formed on said open ends so that a coupling length between said resonant lines and a coupling length between said first and final stage resonant lines and said input/output lines are equal.

14. The microwave band-pass filter according to claim 13, wherein said fourth portion of rectangular form has a length equal to the length of the guard electrode and a width equal to the width of the input line, and a side in a length direction of the rectangle is continuous with a side of the resonant line.

15. The microwave band-pass filter according to claim 13, wherein said fourth portions are shortened by the length of the guard electrode such that a right triangle is formed having one side with a length corresponding the width of an open end and another side with a length corresponding to the length of the guard electrode.

* * * * *